United States Patent [19]

Mayer

[11] 4,402,033

[45] Aug. 30, 1983

[54] SENSITIVE RELAY WITH HIGH THRESHOLD STABILITY

[76] Inventor: Ferdy Mayer, 18, rue Thiers, 38000 Grenoble, France

[21] Appl. No.: 88,594

[22] Filed: Oct. 26, 1979

[30] Foreign Application Priority Data

Oct. 23, 1978 [FR] France ..... 78 30442
Oct. 19, 1979 [FR] France ..... 79 14917

[51] Int. Cl.[3] ..... H01H 47/32
[52] U.S. Cl. ..... 361/187; 361/210
[58] Field of Search ..... 361/152, 187, 210; 331/112

[56] References Cited

U.S. PATENT DOCUMENTS

| | | | |
|---|---|---|---|
| 2,982,887 | 5/1961 | Seeley | 361/187 |
| 2,986,677 | 5/1961 | Hechler | 361/187 |
| 3,387,187 | 6/1968 | Haight | 361/187 X |
| 3,668,557 | 6/1972 | Johnson | 331/112 |
| 3,978,390 | 8/1976 | Remery | 331/112 X |
| 4,019,114 | 4/1977 | Huellwegen | 331/112 X |

FOREIGN PATENT DOCUMENTS

| | | | |
|---|---|---|---|
| 1351233 | 3/1963 | France | 361/210 |
| 475661 | 8/1969 | Switzerland | 361/152 |
| 870619 | 6/1961 | United Kingdom | 361/210 |
| 484627 | 12/1975 | U.S.S.R. | 331/112 |

OTHER PUBLICATIONS

IBM Technical Disclosure Bulletin–"Reed Relay Feedback Latch"–vol. 4, No. 11, p. 48, 4/62.

*Primary Examiner*—Harry E. Moose, Jr.
*Attorney, Agent, or Firm*—Oblon, Fisher, Spivak, McClelland & Maier

[57] ABSTRACT

A power activation device is provided which is controlled by an electrical signal so that the effective power activation signal wave form is made independent of the control input signal wave form through the use of a precise activation threshold so that the control input signal and the power activation signal are directly correlated through the same two input terminals. The precise activation threshold is determined by threshold elements such as a zener diode and the effective control signal which is supplied from the zener diode is independent of the input signal in both shape and duration.

5 Claims, 25 Drawing Figures

SENSITIVE RELAY WITH HIGH THRESHOLD STABILITY

BACKGROUND OF THE INVENTION

1. Field of the Invention

This invention relates to a sensitive relay of the polarized type wherein the thresholds thereof are precisely defined, regardless of the characteristics of the relay.

2. Description of the Prior Art

It is known that all electromechanical relays have rather imprecise closing and opening thresholds, which render their application difficult in threshold-type functions, i.e., those in which their operation is to be controlled for a defined value of control current or voltage, especially if these vary slowly.

More particularly, in sensitive relays of the polarized type, this mechanical instability is compounded by magnetic instability.

One particularly interesting type of polarized sensitive relay is the Hughes relay with all its numerous described variants (e.g., French Pat. No. 2,087,977). It consists of a relay in which the movable armature is closed when at rest and held closed (against an opposing force) by means of the permanent flux created by a magnet or solenoid. An electrical pulse, injected into a coil around the stationary or movable armature of the relay, momentarily cancels this permanent flux and the armature opens.

In principle, the electrical release threshold (i.e., the pulse amplitude) is perfectly defined; but in practice, even here, the instability of polarization, of the air gap, and of the armature return force, as well as shocks, vibrations, etc., make the opening threshold of this relay unreliable. This relay has the advantage of being very sensitive and of being able to operate by direct or alternating current. In the latter case, the alternation of the correct polarity comes into play, at least as long as its duration is greater than or equal to the response time of the relay, i.e., the time for the movable armature to move far enough away from the stationary armature for the movement to become irreversible. An additional drawback of this relay appears when the control voltage pulse becomes clearly greater than the threshold value. Here the electrical excitation (amperes×revolutions) in opposition to the permanent polarization of the relay will not only "depolarize" the relay (the case of the permanent polarization magnet) but will also eliminate all release (here the relay holds by inverse magnetic induction).

For example, in the case of a sinusoidal control current, if the electrical angle at which excitation passes into the flux reduction zone (encouraging release) becomes small, i.e., less than the time required for the movable armature to reach the point of no return, the relay no longer responds. This is obviously unacceptable in all electrical protection applications, e.g., where even large overloads must open the relay so as to protect a facility.

Some of the cited drawbacks were eliminated in a recent concept (e.g., French Pat. Nos. 1,323,673; 1,358,355; 1,407,271; 1,411,747; and the patent cited above) in which the operating threshold of the relay was determined solely by the threshold of a four-layer diode type electronic switch (e.g., a Shockley diode) or equivalent circuits (U.S. Pat. No. 2,655,609).

However, the very principle of these electronic threshold switches does not enable precise thresholds to be obtained, except to the extent that the as yet unexcited currents delivered by the signal source are sufficiently strong. This limits the maximum sensitivity which may be practically attained, as well as the sensitivity of the threshold, if the source is of the microenergy type, i.e., the high internal impedance type.

Finally, in the cited electronic threshold relays, applied to the principle of amplification by accumulation, the "microenergy" accumulated progressively in a storage element (such as a capacitor) is discharged through the electronic threshold switch into the opening or closing relays. The very principle of this discharge (charged capacitor delivering onto an essentially inductive charge) translates into poor energy adaptation since sinusoidal current, with relatively slow set-up of the excitation current, is unfavorable.

SUMMARY OF THE INVENTION

An object of the invention is to describe a sensitive relay (by attraction or release) in which the threshold(s) is defined precisely, regardless of the mechanical characteristics of the relay. The "mechanical" threshold is replaced by the characteristic of a simple, electronic threshold component, such as a semiconducting junction with a pronounced and stable bend.

Another object of the invention is to describe a sensitive relay using this precise threshold in connection with a low leakage-current electronic circuit, enabling attainment of a very high operating sensitivity through the principle of electrical accumulation and by obtaining an especially low pre-excitement current.

A further object of the invention is to describe such a sensitive relay using a polarized structure which, in case of overload, would not cause operating discontinuities, i.e., one having a much greater dynamic operating range.

A still further object of the invention is to describe such a sensitive relay (by attraction or release) which, whether controlled by direct or alternating voltage of slow or fast variation, renders the form of said control voltage compatible with the optimum operation of the relay from the point of view of threshold, duration and energy. In particular, regardless of the control signal, an excitation pulse of the rectangular type is sought, having a constant amplitude sufficient for mechanical operation (regardless of input amplitude) and a constant duration sufficient to bring about mechanical operation (regardless of the form of input). In the case of the polarized release relay, the latter condition corresponds to the irreversibility of release of the movable armature.

Yet another object of the invention, in order to give the relay maximum sensitivity, is to use an electromechanical relay structure consistent with as rapid an operation as possible (starting and stopping of the action), which enables, with the latter condition, and particularly with the polarized release relay, increases in the sensitivity resulting from the input signal.

Finally, another object of the invention, due to the separation of the threshold function from the electromechanical one, together with the simplicity of the electronic circuit, linked to the use of a cheap electromechanical relay (since the stability of its characteristics is not a factor), is the attainment of a modular assembly at low cost. The assembly may be presented in the form of a passive component, like a classic relay, adaptable to a great range of nominal operating voltages and nominal powers (and other specifications), according to the availability of electronic threshold elements, from several volts to several hundred volts, and the variety possible in the construction of the electromechanical part.

The purpose of the invention is to provide a power activation device controlled by an electrical signal, having a precise activation threshold, characterized in that the effective control signal of the power component is made independent of the input signal in its shape and duration, and that this structure is adapted to the needs of the power activator from the point of view of sensitivity, energy yield, and speed of response.

DETAILED DESCRIPTION OF THE PREFERRED EMBODIMENTS

Figure 1:
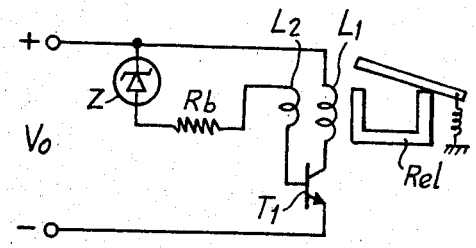
FIG. 1 represents schematically the circuit principle of the relay according to the invention.

The principle of the general circuit is the following. The electromechanical relay comprises at least two coils. The first, the "charge" winding, is controlled by an amplifier element (e.g., transistor) while the second serves as a reaction winding linked to the control of said amplifier. If, proceeding from a voltage threshold element (such as a Zener diode), a reaction phenomenon is begun, a rigid-front, short duration current pulse is obtained in the charge winding, activating the electromechanical part of the relay.

The operation is therefore analogous to that of what is commonly called a monostable blocking oscillator, in which the reaction transformer consists of a relay, the opening trigger proceeds from the voltage threshold element, and the source of the trigger is merged with the control signal. This control signal may be direct (with the source supplying the energy for operation of the relay directly), corresponding to constant supply, or accumulatory (with the source supplying a signal which is first accumulated in an energy reservoir such as a capacitor, and then suddenly discharged), corresponding to variable supply. Such a circuit, once opened, induces a single, high-amplitude oscillation in the charge. This oscillation may take the form of a pulse in accordance with the invention. For the principle of the monostable blocking oscillator, reference is made to the following bibliographical works: *Wave Generation and Shaping,* by Leonard Strauss (Frederick Emmons Terman), page 357, chapter 12, "The Blocking Oscillator;" *Pulse Electronics,* by Raphael Littauer (Frederick Emmons Terman), page 435, chapter 15; *Pulse, Digital and Switching Waveforms,* by Millman and Taub (Frederick Emmons Terman), pages 598, 601 and 607.

FIG. 1 represents an elementary diagram using a basic opening in a common, series reaction, emitter circuit, which will serve for the detailed description of the operating principle of the invention. A direct current control signal will be considered first. In this figure, Rel represents an ordinary attraction relay, comprising two coils $L_1$ and $L_2$ (the relay armature is open when at rest). Main winding $L_1$ is intended to feed its operation through the collector of transistor $T_1$. The base circuit of this transistor comprises, in series, secondary winding $L_2$ of relay Rel and a voltage threshold element, here a Zener diode Z. An increase in control signal Vo will be considered first, with the indicated polarities. As long as voltage Vo has not reached Zener voltage Vz, no current can pass into the base and the circuit is at rest. As soon as Vo reaches Vz, a very slight current begins to flow through the base of transistor $T_1$, which immediately amplifies it. This amplified current, which is recovered in the collector, crosses relay winding $L_1$. By induction, with the relay operating as a transformer, a "reaction" voltage is recovered at the terminals of winding $L_2$. Since it is in series with the base circuit, and on the condition that it have the correct polarity (indicated by dots), it reinforces the initial control force, etc. In a very short time, independently of selfinductance $L_1$, transistor $T_1$ is saturated and the relay is fed at voltage Vo.

With the collector current no longer varying, the reaction voltage at the terminals of $L_2$ falls and an inverse reaction occurs. As suddenly as the phenomenon starts, it stops. A quasi-rectangular pulse will have been furnished to the relay, according to one object of the invention. The amplitude, duration and shape of this pulse can be controlled, according to another object of the invention, so as best to adapt the signal to the charge from the energy point of view. If voltage Vo remains constant, the phenomenon will then repeat itself.

In practice, the source of voltage Vo has a non-negligible internal impedance. Thus, it can thus be easily verified that the pulse is released if and only if voltage Vo has attained threshold voltage Vz, thus supplying a pulse of amplitude Vo and of a duration determined by the fixed and stable parameters of the circuit, i.e., $L_1$ and $L_2$, the transformation ratio n of transformer relay Rel and additional resistance Rb in series with the base (or the emitter).

In other words, the closing threshold of the relay is determined by Vz and the duration of closing by the characteristics of the circuit.

If it is desired to keep the relay closed, the addition of a Schmitt trigger and other classic "memory" circuits are obvious solutions. For example, according to FIG. 2, the classic relay closer is used by means of winding $L_3$—provided to keep the armature drawn under nominal voltage Vo without being able to close said armature when Vo is applied. If Vo is applied to the terminals of the assembly, increasing from zero, the relay closing threshold will be determined exactly by Vz, the threshold voltage of Zener diode Z. The direct reaction will in effect provide a powerful pulse, inducing attraction. Once closed, the movable armature remains closed by the maintenance current in winding $L_3$.

In other words, the equivalent of a classic relay will have been obtained, with an exact working threshold and a much faster closing (no time constant due to selfinductance) than for an ordinary relay.

Figure 3:
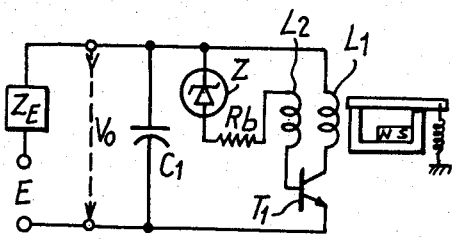
FIG.3 shows application of this principle to a sensitive polarized release relay, using the principle of the accumulation amplifier.

It can be verified that the operation described for these circuits can be used with a high-impedance source, using the principle of energy accumulation or storage. In FIG. 3, $Z_E$ represents the high internal impedance of source E, an impedance such that it can not directly provide the energy necessary for operation of the relay. In this figure, for example, release relay Rel, polarized by a small magnet N-S, was used. Operation is the same as before, as soon as the voltage at the terminals of storage capacitor $C_1$ has attained the value Vz. This time, it is capacitor $C_1$ which provides the energy required for pulse formation.

As before, the pulse formed for the relay has an amplitude and duration defined essentially by the parameters of the circuit. For a signal voltage Vo greater than Vz, only the frequency of the pulses changes, leaving intact their shape and amplitude. Capacitor $C_1$ may be discharged practically completely, thus attaining a maximum energy adaptation of the circuit.

The following are several essential design equations of the circuit.

It is necessary first that the ratio of transformation n of the relay be sufficiently great (with multiplication n of the base side) to arrive at a correct discharge of capacitor $C_1$ (in the case of accumulation circuits) up to a voltage of Vo min. Thus, Vo min. is equal to $Vz/\sqrt{1+n}$. For example, with n=3, Vo min. is one quarter of Vz and only a sixteenth of the stored energy is lost.

Next is necessary that the reaction condition be realized. It is easily determined that this requires a transistor current gain $\beta = Ic/Ib$ at least equal to $\beta \geqq n.\sqrt{1+(Rp/Lp\omega)^2}$ where the denominator corresponds to the "low frequency" response of the transformer relay (with Rp the total resistance in the primary and Lp the inductance of the transformer relay returned to the primary). This value of $\beta$ corresponds to the dynamic or static current gain (fast or slow variation of Vo) of the transistor, and to the very weak collector currents Ic. In fact, it is in this region that the circuit starts through the current provided by threshold element Z. This relationship shows an essential characteristic of the invention: the denominator which describes the "passband" of the transformer relay must be constructed so as to let pass the slowest frequency (i.e., the rise in voltage) of the control signal. The relay thus does not respond to an infinitely slow signal voltage rise. However, as long as the term $(Rp/Lp\omega)^2$ does not become low with regard to unity, sensitivity will depend on this rise time. (It will be seen later how in all cases of slow control this problem is resolved.)

In a numerical example, the value of 20 will be given to the term $\sqrt{1+(Rp/Lp\omega)^2}$. Then, with the above-mentioned ratio n, one arrives at a minimum $\beta$ factor of 60, the value necessary for the low base current values Ib and collector current Ic at start-up.

It will be noted here that all of the threshold switches mentioned in references, such as the Shockley diode or two transistors mounted inversely parallel to simulate it, have as a condition for starting the reaction avalanche that $(1-\beta_1 \cdot \beta_2) \leqq 0$, in which $\beta_1$ and $\beta_2$ correspond to the gains of the two superimposed structures npn and pnp, and in which current control for low currents is practically impossible.

In accordance with this invention, there occurs only one value of $\beta$, easily controlled in a transistor, and one constant factor (the above equation) tied to the circuit's constants.

By way of example, several practical values will be analyzed numerically according to the invention, particularly the connection between the threshold stability obtained, taking the above relations into account, with the variation in gain $\beta$ of transistor $T_1$, particularly at low values of collector current Ic, and with temperature, according to the static or dynamic state, and with the real characteristics of Zener diode Z.

Figure 4:
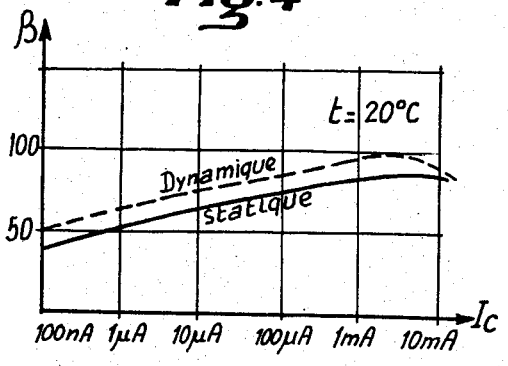
FIGS. 4 and 5 are diagrams showing the gain variations of typical transistors (in terms of the current collector) used as active elements in the foregoing circuits, the first according to state (static or dynamic), the second according to temperature.

In FIG. 4, the variation of $\beta$ in terms of Ic has been reproduced for transistors of the cheap integrated type (arrays). It can be clearly seen that gains greater than 50 are easy to attain.

It will be further noted that the static and dynamic gains are different and vary with regard to each other by 10 to 30%, corresponding (for $\beta = C^{te}$) at one order of magnitude of variation of Ic.

Figure 5:
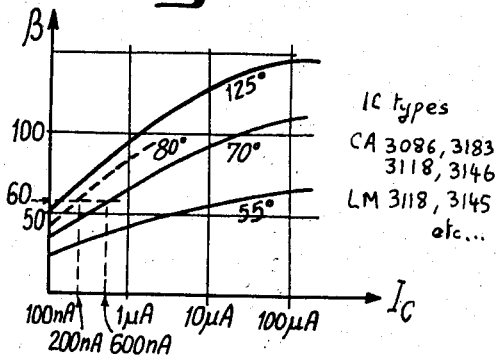
Figure 6:
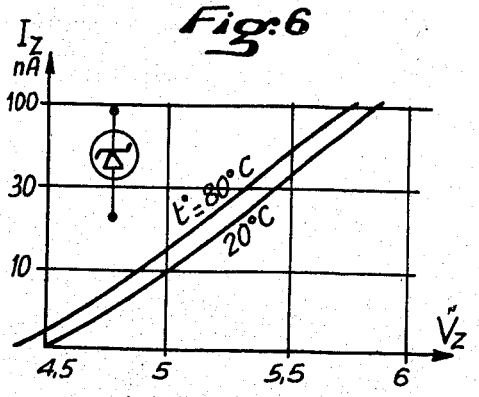
FIGS. 6 and 7 are diagrams showing the Zener-type characteristics of the threshold element in the foregoing circuits, using a classic Zener diode (FIG. 6 and a transistor junction (FIG. 7)

FIG. 5 reproduces several $\beta$ variation curves for different temperatures, for cheap integrated transistors, in which edge current effects are not protected against. Consider, for example, a static $\beta$ of 60 (the case above, with slow variation of the signal). With a classic integrated transistor at 20° C., a collector current of approximately 600 nA is thus required to start the reaction, corresponding to a base current Ib of approximately 10 nA. At 80° C., the circuit starts at $Ic \approx 200$ nA approx., corresponding to a base current of approximately 10 nA. These base currents are supplied by a Zener diode, or a Zener-connected transistor, or any reference element having a pronounced bend for low currents (avalanche effect, tunnel effect, punch-through, integrated zener, etc.). FIG. 6, for example, indicates the Zener characteristic of one of the best commercial Zener diodes, responding to these requirements, for several temperatures.

Figure 7:
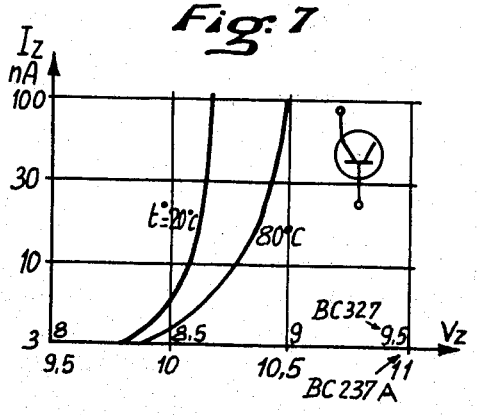
Figure 8:
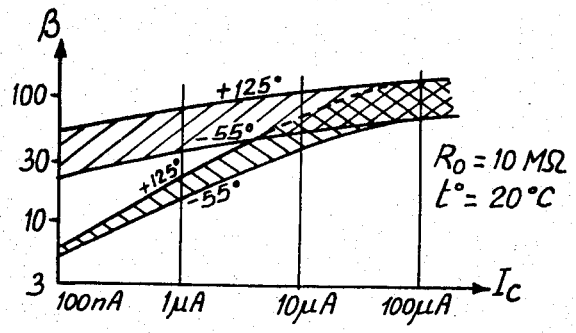
FIG. 8 is a diagram explaining a transistor gain stabilization-type construction, as a function of temperature.

For 10 nA, the Zener voltage is 5.00 V at 20° C. and for 3.4 nA, 4.55 V at 80° C. The stability of the static threshold is thus approximately 4.77±5%. In the same way, the use of an avalanche transistor base-emitter junction (such as BC237A, FIG. 7) would give 10.1 V (20° C.) and 10.0 V (80° C.), with still better threshold stability because of a compensation effect. The appearance of the curves would obviously suggest transistors with gains decreasing regularly as Ic decreases but stable as a function of temperature, as could be realized, for example, by a parallel resistance Ro between transistor base and emitter (FIG. 8).

In the dynamic state, with a rapid variation in the input signal, $\beta$ is somewhat greater and the corresponding Ic current therefore somewhat weaker, which amounts to a greater sensitivity and a slightly reduced threshold voltage. According to the invention, rapid variation (even with a slow varying input signal) can be obtained through the addition of a fast varying voltage or voltage Vo, or simply to the connection feeding the Zener diode, thus enabling obtainment of the dynamic state for optimum operation of the relay-transformer and the transistor.

It will be seen from the following that operation with Vo, in the form of pure alternating voltage, or an alternating component added to a direct component, solves this problem. Further on, an example will be given of a circuit in which the rapid variation component is set apart in the rectifier circuit which delivers Vo.

It is interesting to consider the sensitivity which corresponds to the above figures. Setting off the reaction at 20° (the most unfavorable case) requires 10 nA at a voltage of 10V, for example. This corresponds to a relay sensitivity of a tenth of a microwatt. The example described, with the purpose of clarifying the object of the invention, does not stretch the possibilities of semiconductor technology. The use of integrated transistors will be presented below, which today can be constructed with gains of $\beta \geqq 100$ (npn) or 50 (pnp) for Ic as low as 10 nA. These same integrated transistors, connected in a Zener configuration, exist with leakage currents of 0.002 nA at 20° C. (doubling at every 10° C.).

Figure 9:
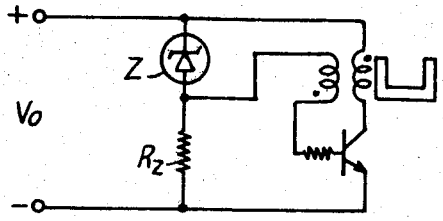
FIGS. 9, 10 and 11 represent variants of the basic circuit, using resistors, capacitors and a diode in the basic circuit of the active element.

As an example of the invention, a summary description of a reduced response relay will follow, in order to demonstrate the stability of the threshold that is possible. Problems of stability as a function of temperature, the collector current, etc., may be eliminated by connecting a resistor Rz of relatively low value as shown in FIG. 9. For $R = 100\ k\Omega$ for example, a threshold precision of better than 1% is possible with a classic Zener diode Z.

At the outset of excitation, the base current is weak with relation to the current in the series connection of the Zener diode and resistor Rz. The operating point may be placed far beyond the bend and a very stable threshold may be obtained by a constant voltage threshold and variation of $\beta$ with Ic. The current in the Z-Rz connection obviously charges the source, proportionally diminishing response.

Figure 2:
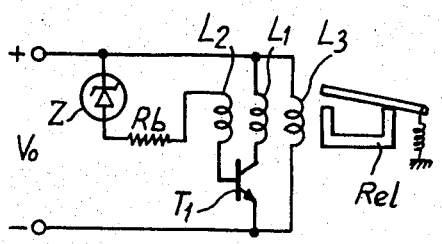
FIG. 2 shows the application of this principle to a standard closing relay.

It is obvious that a large number of precise circuits may be used, taking FIGS. 1, 2 and 3 as points of departure. Configurations having a common base and collector have already been mentioned. The Zener diode may be placed in the emitter or in the base-collector avalanche transistors (e.g., PN 3642). The Zener effect can be directly obtained by this junction. (For details, see the cited bibliographical references.)

Figure 10:
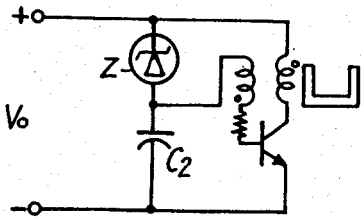
Figure 11:
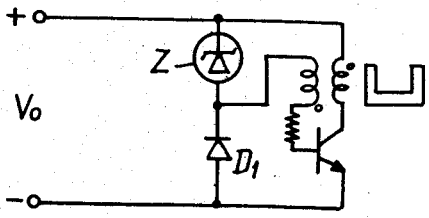
Figure 12:
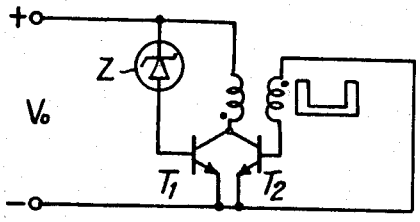
FIG. 12 shows another variant, with separation of the two functions of control and reaction.

Additional perfections may be made to the main circuits described. In FIG. 10, a capacitor $C_2$, and in FIG. 11, a diode $D_1$ (having low internal voltage drop), enable obtainment of a path for the reaction voltage (fast variation), avoiding equalization of the voltage of Zener diode Z. This enables a more thorough discharge of capacitor $C_1$ and the transformation ratio n can be lower, leading to a gain in response. The same result may obviously be obtained if a second reaction transistor (FIG. 12) is provided, relaying the first one immediately upon start-up of the reaction.

A recovery diode placed on one of the windings of the transformer relay, on all of these circuits, also enables conduction to be prolonged.

Figure 13:
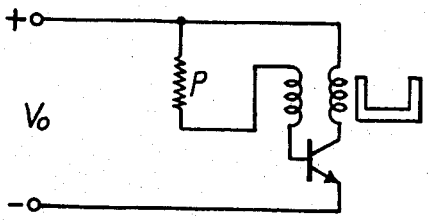
FIG. 13 shows another variant with direct current control.

In the various arrangements considered up to now, a Zener element was used to define the threshold. For the threshold, especially if it does not need to be precise (the case with very sensitive relays)—because of the connection between the reaction condition and gain $\beta$ on the one hand and the relation between $\beta$ and base current Ib on the other—current control is perfectly possible. In this case (FIG. 13), resistor $\rho$, for a certain value of control signal Vo, supplies the base current necessary for starting the reaction. In view of the increase in response of the transistor when the temperature rises, this resistor is advantageously of the "positive temperature coefficient" type. Conversely, if $\rho$ is fixed, a negative temperature coefficient resistor may be placed between it and the ground to obtain an identical effect. Said resistor $\rho$ may also be of the "voltage variable" type, such as an MOV resistor.

Figure 14:
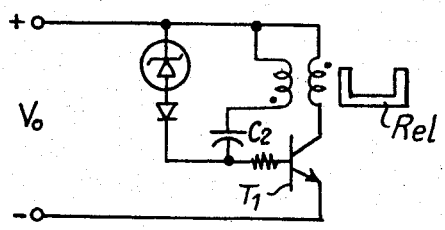
FIG. 14 shows another variant with a parallel reaction.

In the various arrangements containing a single transistor thus far considered, injection of the reaction was in series with the Zener voltage. FIG. 14 shows the principle of parallel injection by capacitor $C_2$ (return of secondary coil to Vo or ground). In its place, a diode may also be used.

Figure 15:
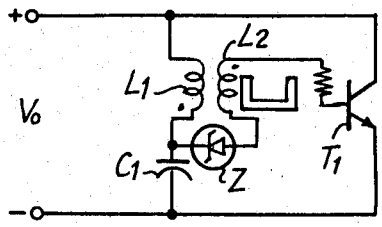
FIG. 15 shows another variant of the "reversed" type avoiding overload of the relay.

In a number of applications with accumulation by capacitor $C_1$, voltage Vo may become much greater than threshold voltage Vz. This is the case particularly with high internal impedance sources. The variant of FIG. 15 may therefore be useful, where $C_1$ is charged across coil $L_1$ of the relay, preventing the anticipated excitation. In another connection, transistor $T_1$ plays the role of crow-bar, once excited, protecting the relay against overload.

Finally, the npn transistors shown may be replaced by pnp transistors, or, more generally, by any active semiconductor (with power gain) having low input current, in which this gain is or can be made variable with this signal so as to define a threshold directly or in connection with an additional threshold element (MOS, FET transistors, etc.).

Figure 16:
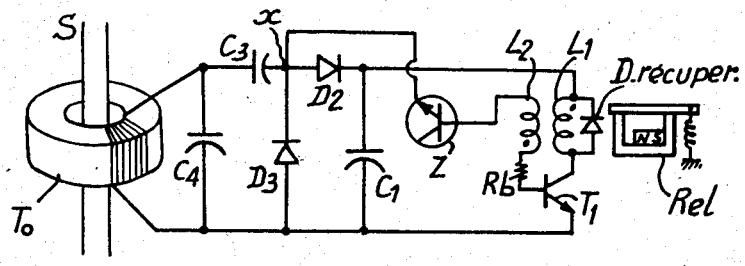
FIG. 16 shows a sample application of a sensitive release relay using discrete components.

Detailed description of a circuit according to the invention will follow by way of example (FIG. 16). Here, a sensitive relay according to the invention is applied to control of a high response, differential circuit-breaker. The circuit is constructed using cheap or inexpensive transistors to achieve the blocking and the reference voltage. In this figure, To represents a differential toroid, excited by the phases of circuit S. Its secondary coil is set up to supply a voltage which, rectified and doubled, is to supply the blocking threshold volage for a differential current of 30 mA (an example of a response currently used for protection against electrocution). Capacitor $C_4$ at the terminals of this winding is provided in order to harmonize this secondary coil with the frequency of the circuit. Its role is to provoke an overvoltage (reduced, it is true, because of the poor electrical characteristics of the secondary), but above all to limit the rectified voltage for high differential overloads. In effect, the toroid then becomes saturated and consequently the accord is displaced progressively over the higher and higher harmonics (odd) of the circuit, without the crest voltage increasing much. (Without capacitor $C_4$, the rectified crest voltage would be exactly proportional to the crest value of the differential current). An appropriate rectifier circuit rectifies this voltage supplied by the toroid. In the example, $D_2$, $D_3$, $C_1$ and $C_3$ constitute a classic voltage doubler in which capacitor $C_1$ constitutes the capacitor-reservoir for the blocking circuit. The capacitor $C_1$ is thus progressively charged (the alternating source corresponds to a high impedance source), accumulating the defect energy.

The moment is now considered where this voltage has reached Zener voltage Vz, produced here by Zener-connected transistor Z, i.e., the moment at which the current at the transistor base $T_1$ is slightly lower than the value required to set off the reaction.

According to the invention, an alternating voltage is injected in parallel or in series onto the base, e.g., at point X shown (or directly at the high terminal of the toroid), which creates a precise dynamic state (here due to the 50 Hz of the circuit, around the threshold response of 30 mA), defining the reaction loop gain of the transistor and of the transformer-relay. Superposition of the two sets off the reaction and the relay-transformer is traversed by a short, precise pulse, for the opening.

Figure 17:
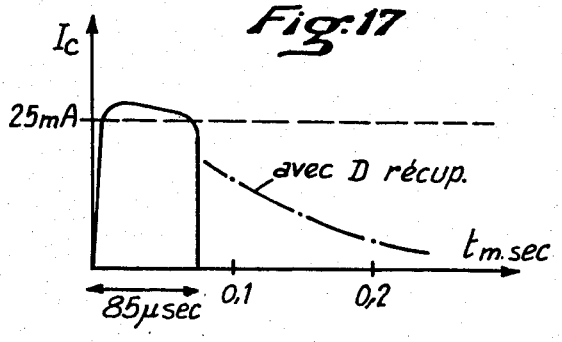
FIGS. 17 and 18 are diagrams showing the control current forms in the relay compared with the current obtained in a threshold switch circuit of the Shockley diode type.

In a typical circuit, using two BC 327 type transistors (for Z and T), the opening voltage is around 9 V. For a release-type relay-transformer as described below, comprising 3,000 turns in the primary (collector, approximately 200Ω resistance), 9,000 turns in the secondary (base), and a storage capacitor $C_1$ of 0.22 μF, a control current of the form indicated in FIG. 17 is obtained for an optimum base resistance of Rb=100ωΩ.

The pulse has a duration of 85 μsec. which is slightly higher than the response time of the relay (see below), with a rise time of less than 5 μsec.. The relay release threshold is 25 mA.

Figure 18:
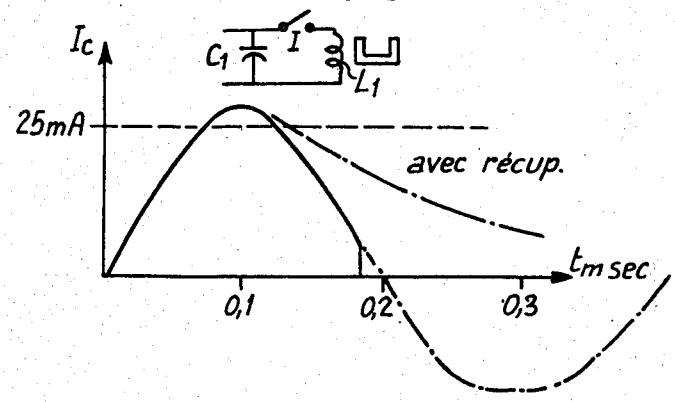

An essential advantage in accordance with the invention appears in the comparison of this waveform with that of the threshold switch accumulation circuit of the Shockley diode type or its equivalent, described in the introduction of this invention. For the same values of $C_1$ and $L_1$, once threshold switch I is activated, discharge is oscillatory (see FIG. 18) and the energy (surface under the curve=$o\int^t i(t)dt$) required for opening is much greater. This aspect of making the form of current in the relay consonant with its optimum speed for this type of relay is one of the characteristics of the invention.

For nominal sensitivity (differential current of 30 mA), the charge time (i.e., accumulation time) of $C_1$ is approximately one second. For charging, the blocking control current must then be very slightly less than the current supplied by the signal. The excitation current corresponds essentially to the $T_1$ base current and is approximately 30 nA at 20° C. and 10 nA at 80° C. The control signal power of 9 V·30 nA=0.27 μW gives rise to a relay pulse power of approximately $R_{L1}\cdot Ic^2=200(30\cdot 10^{-3})^2=0.18$ W. This shows the importance of "power amplification by accumulation."

It is obvious that this "gain" is obtained by virtue of the high ratio of integration time T (time for charge of $C_1$ to threshold voltage) to the duration of pulse t. The quantity of charge added to input $o\int^t i(t)dt$ for this circuit is easy to calculate, using an initial input current on the order of 15 μA, decreasing more or less exponentially to 30 nA in one second: the value of 5μ coulombs obtained compares favorably with the opening energy in the relay (FIG. 17), which is approximately equal to 2.6μ coulombs.

In the example, the dynamic opening state is obtained through direct connection with the alternating current source. Instead of this "galvanic" injection, a locally obtained capacitive or inductive injection could obviously be used. A typical example consists of bringing the base circuit conductor closer to the circuit wires, or creating an inductive loop coupled to it.

Finally, in this example, the opening threshold and proper operation of the relay are ensured between 30 mA and several thousandths of an ampere, something impossible to achieve with direct excitation of sensitive relays. The current form in FIG. 17 clearly shows constant amplitude, whatever the excitation. It further eliminates any magnetic instability of demagnetization of the polarization magnet as occurs with direct excitation relays.

In other embodiments, the slowest rise time (determining reaction conditions) may be intrinsic to operation of the source.

Finally, for the extreme cases of a very slowly varying, perfectly direct signal source, the blocking circuit may be completed in accordance with the invention by a small, local, micropower oscillator for supplying the several mV necessary for the very high impedance represented by the base at excitation. In a variant, a part or all of the relay coils may form an active part of this oscillator.

In the example, the control signal was alternating (50 Hz) while the blocking operation was essentially direct. In accordance with the invention, because of the very rapid operation of the relay, blocking may be fed directly with unsmoothed alternating current where this feed includes a capacitor of the harmonizing type ($C_4$ of FIG. 16).

This voltage may be directly delivered by the source outlet at terminals X for example, $C_1$ and $D_3$ being absent and $C_3$ being replaced by a short-circuit. An in-series protection diode prevents excess current from inhibiting or destroying the electronic wiring.

The preceding example has clearly shown that the sensitivity of the relay (or its power amplification) in accordance with the invention is directly linked to the speed of response of the relay-transformer. A preferential choice thus consists in a polarized release relay, the movement of which becomes irreversible as soon as the air gap (due to the opening of the movable armature) has exceeded several dozen μ. It is this which enables an "electrical" response time as short as several dozen μsec. (85 μsec. in the example).

According to the invention, such a relay is characterized by optimum transformer and relay operation simultaneously (particularly with raised permeability, and use of one or more reduced, but constant air gaps) by a rapid variation of the air gap(s) as a function of the movement of the movable armature (to attain the indicated irreversibility) and as a function of time by a minimum moving mass. The electrical sensitivity of this relay (to external magnetic fields) will be reduced by flux which is as direct as possible and by a compact shape. The mechanical sensitivity (to shocks, vibrations) will be reduced by one or more moving parts which are as light as possible.

It appears clearly from the above circuit examples that even though the flow of the circuit trigger signal (exciting the transistor base, for example) and the flow of the relay control power start from a common source, which thus contains both the control signal (e.g., the voltage level) and control power, this is not necessarily the case in this invention.

Figure 19:
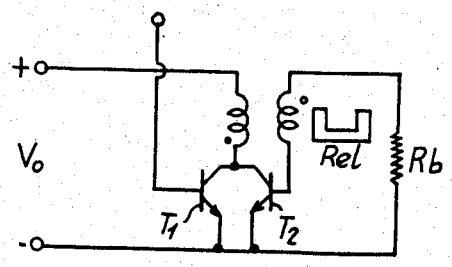
FIG. 19 shows another sample application of a sensitive relay using integrated components.
Figure 20:
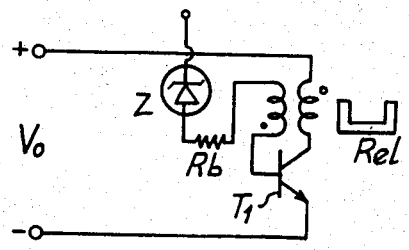
FIGS. 20 through 25 represent various other variants of construction of the relay in accordance with the invention.

FIGS. 19 and 20 show two examples with a control signal which is independent or still connected to source Vo across an "intelligent" introduction, i.e., a particular "interpretation" (level, frequency, waveform, coincidence, addition, subtraction, delay, etc.). By way of example, if the control signal input (FIG. 20) is connected to +Vo across a resistance-capacitance element, a delayed sensitive relay is obtained in which the delay will be a function of the amplitude of Vo.

Figure 21:
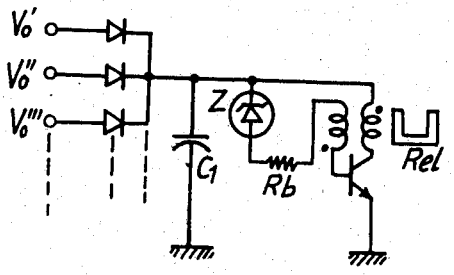
Figure 22:
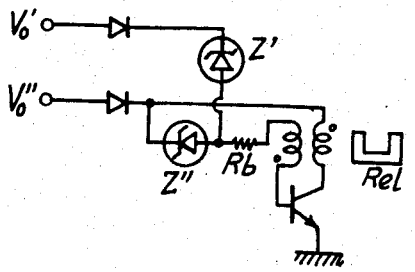

More particularly, all forms of elementary logical functions may thus be realized according to the invention. For example, in FIG. 21 a function is shown into which several signals Vo', Vo'', Vo''' enter, both as control and power source. A sampled application consists of the protective openings of a circuit-breaker due to overloads of various phases of the network, with sources Vo being images of the phase currents. For example, FIG. 22 shows an ET function between two signals. Another sample application, still in the field of electrical protection, consists of the classic differential protection ensured by Vo'' and the rest of the circuit. For example, at Vo', the microsignal coming from a continuous differential component is applied. This control functions only when Vo'' is also present ($V_2''$ will be slightly lower than $V_2'$). In another sample application, Vo'' will play the role of feed solely, with Zener diode Z'' being connected to voltage limiter Vo'' (anode to ground).

Figure 23:
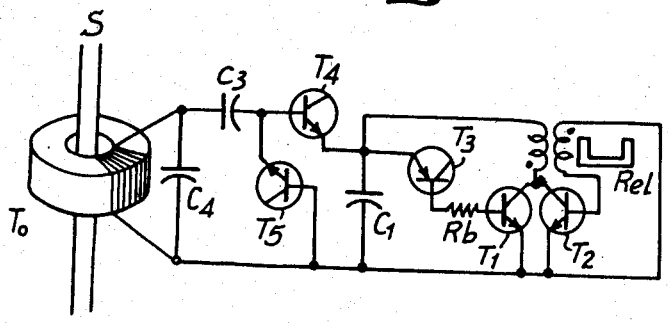

Integration of the threshold, power amplification and reaction functions is possible using modern integrated circuit technology. The possible reduced leakage currents indicated above are then advantageously used according to the invention to attain high sensitivities. By way of example, FIG. 23 shows the use of commercial "transistor array" circuits for construction of a circuit of the type of the FIG. 16 example, in which the pair of transistors $T_1$ and $T_2$ functions analogously to that of FIG. 12, transistor $T_3$ functions as a Zener diode and transistors $T_4$ and $T_5$ function as rectifier-doublers, with at the same time the diode and Zener function of limitation and protection. In this precise example, in which a pair (having common emitters) and three independent transistors are used, the use of commercial circuits of the type LM or CA 3018, 3045, 3046, 3082, 3083, 3086, 3093, 3096, 3097, 3145, 3154, and 3118 is direct. It is obvious that in a "custom" integrated construction, a number of perfections described above or known in the state of the art are advantageously integrated, including interfaces such as rectifiers, limiters, oscillator-triggers, etc., described above.

In the preceding examples, the positive reaction necessary for setting off the operation is obtained by a second winding, ensuring both exclusive coupling of the alternating current type (i.e., the reaction voltage is a function of the speed of variation of the magnetic flux and thus is dependent on frequency) and inversion of the signal (obtained by a transistor amplifier stage) necessary for a positive reaction. It is possible to describe an activator device using only one winding having a reduced number of turns. To do this in accordance with the invention, all that is needed is to provide two semiconductor amplifier stages, cascade connection, to recover the phase coincidence between input signal and reaction signal, i.e., to obtain the double inversion necessary for the positive reaction, with the exclusively alternating reaction coupling being performed by a preferably capacitive coupling between output signal and input signal.

Figure 24:
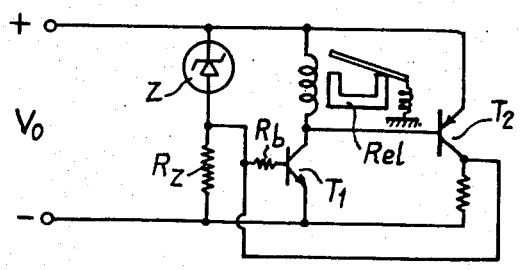

In FIG. 24, the inversion of polarity is obtained by another transistor $T_2$, the base of which is controlled by the collector of transistor $T_1$, and the emitter linked to the positive side of control voltage Vo. This is a reverse polarity transistor, connected so as not to conduct when transistor $T_1$ is blocked.

At start-up, the voltage drop on the collector of transistor $T_1$ is followed by a voltage rise in the collector of transistor $T_2$. Variation of this voltage is coupled on the base of transistor $T_1$, across capacitor C, thus creating the positive reaction. The charge (relay Rel or activator generally) is placed in the collector of transistor $T_1$ or $T_2$. In the same way, in accordance with classic and known techniques, it may be placed in the emitter. It is also obvious that reaction capacitor C may be inserted at other points of the positive reaction loop described.

The time constant of the alternating current coupling, proportional to the value of inductances $L_1$ and $L_2$ is, this time, proportional to the value of C and of $R_z$ and $R_2$. It can be easily verified that it may be much higher with the wiring of FIG. 24. In a practical circuit, $R_z$ and $R_2$ will have typical values higher than the megohm, for example, $R_z = R_2 = 10\ M\Omega$ corresponding to a high sensitivity circuit with classic commercial transistors $T_1$ and $T_2$. Values on the order of 100 MΩ are typical for a very high sensitivity circuit with integrated circuits having low leakage current. Capacitor C will have a value on the order of 10 nF to 1 μF, for example. Resistor $R_2$ may be replaced or supplemented with one or more Zener diodes, giving effective resistance values which are variable with the voltage, so as to optimize the dynamic operation of the circuit.

Figure 25:
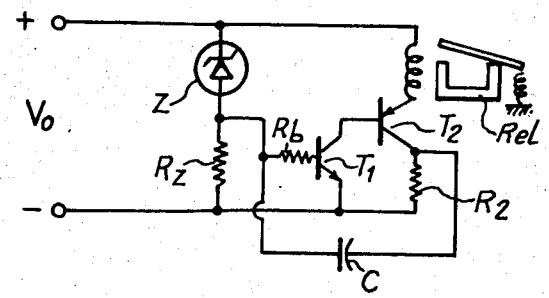

In FIG. 25, the same operation of the reaction is obtained with the placement of the relay within the collector of transistor $T_2$.

Combining the various processes and diagrams above, or combining the latter with known active or passive circuit components, falls obviously within the object of the invention. More particularly, replacement of the relay-transformer with a transformer connected to any other fast action charge, following for example the circuits and uses described in French Pat. No. 2,087,977, is obvious and falls within the scope of the present invention.

I claim:

1. A power activation circuit for a power component comprising:

charging means controlled by an output of a switching means;

reaction means directly connected to an input control of said switching means and to a threshold element in series with said reaction means whereby there is provided by means of said threshold element a precise activation threshold so that the effective control signal of the power component is independent of the input voltage to said threshold element; and whereby there is provided to said power component an essentially rectangular pulse whose amplitude equals the value of said input voltage when said input voltage exceeds said activation threshold of said threshold element and whose duration is determined by the parameters of said charging means and said reaction means.

2. A circuit for an electromechanical relay having a core and at least one movable armature with means for returning said armature to a rest position comprising a first winding $L_1$ controlled by an output of an amplifier element;

a second winding $L_2$ directly connected to an input control of said amplifier and to a threshold element in series with said second winding whereby said first winding acts as a charge winding and said second winding acts as a reaction winding in order to provide from said threshold element an amplifier element power actuation device having a precise activation threshold so that the effective control signal to the relay is independent of an input voltage to said threshold element and whereby there is provided to said relay a essentially rectangular pulse whose amplitude equals the value of said input voltage when said input voltage exceeds said activation threshold of said threshold element and whose duration is determined by the parameters of said first and second windings.

3. An electromechanical relay power activation device with said relay having at least one core and at least one movable armature with means for returning the armature to a rest position and wherein said device comprises two coils for the dynamic operation of activation of which said first coil $L_1$ is a charge winding which is controlled by an output of an amplifier element and said second coil $L_2$ is a reaction winding which is connected to an input of the amplifier through a capacitor and to a threshold element in parallel with said second winding and said capacitor.

4. A device according to any one of claims 2 or 3 wherein a condenser is connected in parallel with said input voltage.

5. A device according to any one of claims 2 or 3 wherein the activation signal of the device supplies both a power signal for feeding said charge winding $L_1$ and a threshold control signal for controlling the activation of said threshold element.

* * * * *

UNITED STATES PATENT AND TRADEMARK OFFICE

CERTIFICATE OF CORRECTION

PATENT NO. : 4,402,033

DATED : August 30, 1983

INVENTOR(S) : Ferdy Mayer

It is certified that error appears in the above-identified patent and that said Letters Patent is hereby corrected as shown below: Cover page,

[30] Foreign Application Priority Data should read

-- October 26, 1978 France.....78 30442

June 5, 1979 France.....79 14917--.

Signed and Sealed this

*Twenty-ninth* Day of *November 1983*

[SEAL]

*Attest:*

GERALD J. MOSSINGHOFF

*Attesting Officer*

*Commissioner of Patents and Trademarks*